US008931854B2

(12) United States Patent
Hall

(10) Patent No.: US 8,931,854 B2
(45) **Date of Patent: *Jan. 13, 2015**

(54) LAYERED POLYCRYSTALLINE DIAMOND

(71) Applicant: Schlumberger Technology Corporation, Sugar Land, TX (US)

(72) Inventor: David R. Hall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/020,000

(22) Filed: Sep. 6, 2013

(65) Prior Publication Data

US 2014/0008131 A1 Jan. 9, 2014

Related U.S. Application Data

(63) Continuation of application No. 12/112,099, filed on Apr. 30, 2008, now Pat. No. 8,540,037.

(51) Int. Cl.

| | |
|---|---|
| ***E21C 35/183*** | (2006.01) |
| ***E21B 10/567*** | (2006.01) |
| *E21C 35/18* | (2006.01) |

(52) U.S. Cl.

CPC ..... *E21B 10/5673* (2013.01); *E21C 35/183* (2013.01); *E21C 2035/1816* (2013.01)

USPC ..... 299/111; 175/428; 175/433

(58) Field of Classification Search

USPC ..... 299/100, 101, 105, 110, 111, 113, 299/112 T, 112 R; 175/374, 375, 420.1, 175/420.2, 425, 426, 428, 430, 434, 435, 175/433

See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |

(Continued)

FOREIGN PATENT DOCUMENTS

| | | |
|---|---|---|
| DE | 4039217 A1 | 6/1992 |
| SU | 1418463 A1 | 8/1988 |

OTHER PUBLICATIONS

Chaturvedi et al., "Diffusion Brazing of Cast Inconel 738 Superalloy," Sep. 2005, Journal of Materials Online, vol. 1 (12 pages).

(Continued)

*Primary Examiner* — Sunil Singh
(74) *Attorney, Agent, or Firm* — Osha · Liang LLP

(57) ABSTRACT

In one aspect of the present invention, a high impact wear resistant tool has a superhard material bonded to a cemented metal carbide substrate at a non-planar interface. The superhard material has a thickness of at least 0.100 inch and forms an included angle of 35 to 55 degrees. The superhard material has a plurality of substantially distinct diamond layers. Each layer of the plurality of layers has a different catalyzing material concentration. A diamond layer adjacent the substrate of the superhard material has a higher catalyzing material concentration than a diamond layer at a distal end of the superhard material.

20 Claims, 6 Drawing Sheets

(56) References Cited

U.S. PATENT DOCUMENTS 1,387,733 A 8/1921 Midgett
1,460,671 A 7/1923 Hebsacker
1,544,757 A 7/1925 Hufford et al.
1,821,474 A 9/1931 Mercer
1,879,177 A 9/1932 Gault
2,004,315 A 6/1935 Fean
2,054,255 A 9/1936 Howard
2,064,255 A 12/1936 Garfield
2,124,438 A 7/1938 Struk et al.
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,545,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,080,934 A * 3/1963 Berscheid ..... 175/420.1
3,135,341 A 6/1964 Ritter
3,254,392 A 6/1966 Novkov
3,294,186 A 12/1966 Buell
3,301,339 A 1/1967 Pennebaker, Jr.
3,379,264 A 4/1968 Cox
3,397,012 A 8/1968 Krekeler
3,429,390 A 2/1969 Bennett
3,493,165 A 2/1970 Schonfeld
3,583,504 A 6/1971 Aalund
3,626,775 A 12/1971 Gentry
3,745,396 A 7/1973 Quintal et al.
3,745,623 A 7/1973 Wentorf, Jr. et al.
3,746,396 A 7/1973 Radd
3,765,493 A 10/1973 Rosar et al.
3,800,891 A 4/1974 White et al.
3,807,804 A 4/1974 Kniff
3,821,993 A 7/1974 Kniff
3,830,321 A 8/1974 McKenry et al.
3,932,952 A 1/1976 Helton et al.
3,945,681 A 3/1976 White
3,955,635 A 5/1976 Skidmore
3,960,223 A 6/1976 Kleine
4,005,914 A 2/1977 Newman
4,006,936 A 2/1977 Crabiel
4,081,042 A 3/1978 Johnson et al.
4,096,917 A 6/1978 Harris
4,098,362 A 7/1978 Bonnice
4,106,577 A 8/1978 Summers
4,109,737 A 8/1978 Bovenkerk
4,140,004 A 2/1979 Smith et al.
4,156,329 A 5/1979 Daniels et al.
4,176,723 A 12/1979 Arceneaux
4,199,035 A 4/1980 Thompson
4,201,421 A 5/1980 Den Besten et al.
4,211,508 A 7/1980 Dill et al.
4,224,380 A 9/1980 Bovenkerk et al.
4,253,533 A 3/1981 Baker, III
4,268,089 A 5/1981 Spence et al.
4,277,106 A 7/1981 Sahley
4,280,573 A 7/1981 Sudnishnikov et al.
4,304,312 A 12/1981 Larsson
4,307,786 A 12/1981 Evans
D264,217 S 5/1982 Prause et al.
4,333,902 A 6/1982 Hara
4,333,986 A 6/1982 Tsuji et al.
4,337,980 A 7/1982 Krekeler
4,390,992 A 6/1983 Judd
4,397,361 A 8/1983 Langford, Jr.
4,412,980 A 11/1983 Tsuji et al.
4,416,339 A 11/1983 Baker et al.
4,425,315 A 1/1984 Tsuji et al.
4,439,250 A 3/1984 Acharya et al.
4,445,580 A 5/1984 Sahley
4,448,269 A 5/1984 Ishikawa et al.
4,465,221 A 8/1984 Schmidt
4,481,016 A 11/1984 Campbell et al.
4,484,644 A 11/1984 Cook et al.
4,484,783 A 11/1984 Emmerich
4,489,986 A 12/1984 Dziak
4,499,795 A 2/1985 Radtke
4,525,178 A 6/1985 Hall
4,531,592 A 7/1985 Hayatdavoudi
4,535,853 A 8/1985 Ippolito et al.
4,538,691 A 9/1985 Dennis
4,566,545 A 1/1986 Story et al.
4,574,895 A 3/1986 Dolezal et al.
4,599,731 A 7/1986 Ware et al.
4,604,106 A * 8/1986 Hall ..... 51/293
4,627,503 A 12/1986 Horton
4,636,253 A 1/1987 Nakai et al.
4,636,353 A 1/1987 Seon et al.
4,640,374 A 2/1987 Dennis
4,647,111 A 3/1987 Bronder et al.
4,647,546 A 3/1987 Hall, Jr. et al.
4,650,776 A 3/1987 Cerceau et al.
4,662,348 A 5/1987 Hall et al.
4,664,705 A 5/1987 Horton et al.
4,678,237 A 7/1987 Collin
4,682,987 A 7/1987 Brady et al.
4,684,176 A 8/1987 Den Besten et al.
4,688,856 A 8/1987 Elfgen
4,690,691 A 9/1987 Komanduri
4,694,918 A 9/1987 Hall
4,725,098 A 2/1988 Beach
4,726,718 A 2/1988 Meskin et al.
4,729,440 A 3/1988 Hall
4,729,603 A 3/1988 Elfgen
4,765,686 A 8/1988 Adams
4,765,687 A 8/1988 Parrott
4,776,862 A 10/1988 Wiand
4,852,672 A 8/1989 Behrens
4,880,154 A 11/1989 Tank
4,889,017 A 12/1989 Fuller et al.
D305,871 S 2/1990 Geiger
4,921,310 A 5/1990 Hedlund et al.
4,932,723 A 6/1990 Mills
4,940,099 A 7/1990 Deane et al.
4,940,288 A 7/1990 Stiffler et al.
4,944,559 A 7/1990 Sionnet et al.
4,944,772 A 7/1990 Cho
4,951,762 A 8/1990 Lundell
4,954,139 A 9/1990 Cerutti
4,956,238 A 9/1990 Griffin
4,962,822 A 10/1990 Pascale
4,981,184 A 1/1991 Knowlton et al.
5,007,685 A 4/1991 Beach et al.
5,009,273 A 4/1991 Grabinski
5,011,515 A 4/1991 Frushour
5,027,914 A 7/1991 Wilson
5,030,250 A 7/1991 Burnand et al.
5,038,873 A 8/1991 Jurgens
D324,056 S 2/1992 Frazee
D324,226 S 2/1992 Frazee
5,088,797 A 2/1992 O'Neill
5,101,691 A 4/1992 Barr
5,112,165 A 5/1992 Hedlund et al.
5,119,714 A 6/1992 Scott et al.
5,119,892 A 6/1992 Clegg et al.
5,141,063 A 8/1992 Quesenbury
5,141,289 A 8/1992 Stiffler
D329,809 S 9/1992 Bloomfield
5,154,245 A 10/1992 Waldenstrom et al.
5,186,268 A 2/1993 Clegg
5,186,892 A 2/1993 Pope
5,222,566 A 6/1993 Taylor et al.
5,248,006 A 9/1993 Scott et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer

(56) References Cited

U.S. PATENT DOCUMENTS

| | | | |
|---|---|---|---|
| 5,303,984 | A | 4/1994 | Ojanen |
| 5,304,342 | A | 4/1994 | Hall, Jr. et al. |
| 5,332,348 | A | 7/1994 | Lemelson |
| 5,351,770 | A | 10/1994 | Cawthorne et al. |
| 5,361,859 | A | 11/1994 | Tibbitts |
| 5,374,319 | A | 12/1994 | Stueber et al. |
| D357,485 | S | 4/1995 | Mattsson et al. |
| 5,410,303 | A | 4/1995 | Comeau et al. |
| 5,417,292 | A | 5/1995 | Polakoff |
| 5,417,475 | A | 5/1995 | Graham et al. |
| 5,423,389 | A | 6/1995 | Warren et al. |
| 5,447,208 | A | 9/1995 | Lund et al. |
| 5,494,477 | A | 2/1996 | Flood et al. |
| 5,507,357 | A | 4/1996 | Hult et al. |
| D371,374 | S | 7/1996 | Fischer et al. |
| 5,533,582 | A | 7/1996 | Tibbitts |
| 5,535,839 | A | 7/1996 | Brady |
| 5,542,993 | A | 8/1996 | Rabinkin |
| 5,544,713 | A | 8/1996 | Dennis |
| 5,560,440 | A | 10/1996 | Tibbitts |
| 5,568,838 | A | 10/1996 | Struthers et al. |
| 5,653,300 | A | 8/1997 | Lund et al. |
| 5,655,614 | A | 8/1997 | Azar |
| 5,662,720 | A | 9/1997 | O'Tighearnaigh |
| 5,678,644 | A | 10/1997 | Fielder |
| 5,709,279 | A | 1/1998 | Dennis |
| 5,720,528 | A | 2/1998 | Ritchey |
| 5,732,784 | A | 3/1998 | Nelson |
| 5,738,698 | A | 4/1998 | Kapoor et al. |
| 5,794,728 | A | 8/1998 | Palmberg |
| 5,811,944 | A | 9/1998 | Sampayan et al. |
| 5,823,632 | A | 10/1998 | Burkett |
| 5,837,071 | A | 11/1998 | Andersson et al. |
| 5,845,547 | A | 12/1998 | Sollami |
| 5,848,657 | A | 12/1998 | Flood et al. |
| 5,871,060 | A | 2/1999 | Jensen et al. |
| 5,875,862 | A | 3/1999 | Jurewicz et al. |
| 5,884,979 | A | 3/1999 | Latham |
| 5,890,552 | A | 4/1999 | Scott et al. |
| 5,896,938 | A | 4/1999 | Moeny et al. |
| 5,914,055 | A | 6/1999 | Roberts et al. |
| 5,934,542 | A | 8/1999 | Nakamura et al. |
| 5,935,718 | A | 8/1999 | Demo et al. |
| 5,944,129 | A | 8/1999 | Jensen |
| 5,947,215 | A | 9/1999 | Lundell |
| 5,950,743 | A | 9/1999 | Cox |
| 5,957,223 | A | 9/1999 | Doster et al. |
| 5,957,225 | A | 9/1999 | Sinor |
| 5,967,247 | A | 10/1999 | Pessier |
| 5,967,250 | A | 10/1999 | Lund et al. |
| 5,979,571 | A | 11/1999 | Scott et al. |
| 5,992,405 | A | 11/1999 | Sollami |
| 5,992,547 | A | 11/1999 | Caraway et al. |
| 5,992,548 | A | 11/1999 | Silva et al. |
| 6,000,483 | A | 12/1999 | Jurewicz et al. |
| 6,003,623 | A | 12/1999 | Miess |
| 6,006,846 | A | 12/1999 | Tibbitts et al. |
| 6,018,729 | A | 1/2000 | Zacharia et al. |
| 6,019,434 | A | 2/2000 | Emmerich |
| 6,021,859 | A | 2/2000 | Tibbitts et al. |
| 6,039,131 | A | 3/2000 | Beaton |
| 6,041,875 | A | 3/2000 | Rai et al. |
| 6,044,920 | A | 4/2000 | Massa et al. |
| 6,051,079 | A | 4/2000 | Andersson et al. |
| 6,056,911 | A | 5/2000 | Griffin |
| 6,065,552 | A | 5/2000 | Scott et al. |
| 6,068,913 | A | 5/2000 | Cho et al. |
| 6,098,730 | A | 8/2000 | Scott et al. |
| 6,113,195 | A | 9/2000 | Mercier et al. |
| 6,131,675 | A | 10/2000 | Anderson |
| 6,150,822 | A | 11/2000 | Hong et al. |
| 6,170,917 | B1 | 1/2001 | Heinrich et al. |
| 6,186,251 | B1 | 2/2001 | Butcher |
| 6,193,770 | B1 | 2/2001 | Sung |
| 6,196,340 | B1 | 3/2001 | Jensen et al. |
| 6,196,636 | B1 | 3/2001 | Mills et al. |
| 6,196,910 | B1 | 3/2001 | Johnson et al. |
| 6,199,645 | B1 | 3/2001 | Anderson et al. |
| 6,199,956 | B1 | 3/2001 | Kammerer |
| 6,202,761 | B1 | 3/2001 | Forney |
| 6,202,770 | B1 | 3/2001 | Jurewicz et al. |
| 6,213,226 | B1 | 4/2001 | Eppink et al. |
| 6,216,805 | B1 | 4/2001 | Lays et al. |
| 6,220,375 | B1 | 4/2001 | Butcher et al. |
| 6,220,376 | B1 | 4/2001 | Lundell |
| 6,223,824 | B1 | 5/2001 | Moyes |
| 6,223,974 | B1 | 5/2001 | Unde |
| 6,257,673 | B1 | 7/2001 | Markham et al. |
| 6,258,139 | B1 | 7/2001 | Jensen |
| 6,260,639 | B1 | 7/2001 | Yong et al. |
| 6,269,893 | B1 | 8/2001 | Beaton et al. |
| 6,270,165 | B1 | 8/2001 | Peay |
| 6,272,748 | B1 | 8/2001 | Smyth |
| 6,290,008 | B1 | 9/2001 | Portwood et al. |
| 6,296,069 | B1 | 10/2001 | Lamine et al. |
| 6,302,224 | B1 | 10/2001 | Sherwood, Jr. |
| 6,302,225 | B1 | 10/2001 | Yoshida et al. |
| 6,315,065 | B1 | 11/2001 | Yong et al. |
| 6,332,503 | B1 | 12/2001 | Pessier et al. |
| 6,340,064 | B2 | 1/2002 | Fielder et al. |
| 6,341,823 | B1 | 1/2002 | Sollami |
| 6,354,771 | B1 | 3/2002 | Bauschulte et al. |
| 6,364,034 | B1 | 4/2002 | Schoeffler |
| 6,364,420 | B1 | 4/2002 | Sollami |
| 6,371,567 | B1 | 4/2002 | Sollami |
| 6,375,272 | B1 | 4/2002 | Ojanen |
| 6,375,706 | B2 | 4/2002 | Kembaiyan et al. |
| 6,394,200 | B1 | 5/2002 | Watson et al. |
| 6,408,052 | B1 | 6/2002 | McGeoch |
| 6,408,959 | B2 | 6/2002 | Bertagnolli et al. |
| 6,419,278 | B1 | 7/2002 | Cunningham |
| 6,429,398 | B1 | 8/2002 | Legoupil et al. |
| 6,439,326 | B1 | 8/2002 | Huang et al. |
| 6,460,637 | B1 | 10/2002 | Siracki et al. |
| 6,468,368 | B1 | 10/2002 | Merrick et al. |
| 6,474,425 | B1 | 11/2002 | Truax et al. |
| 6,478,383 | B1 | 11/2002 | Ojanen et al. |
| 6,481,803 | B2 | 11/2002 | Ritchey |
| 6,484,825 | B2 | 11/2002 | Watson et al. |
| 6,484,826 | B1 | 11/2002 | Anderson et al. |
| 6,499,547 | B2 | 12/2002 | Scott et al. |
| 6,508,318 | B1 | 1/2003 | Linden et al. |
| 6,510,906 | B1 | 1/2003 | Richert et al. |
| 6,513,606 | B1 | 2/2003 | Krueger |
| 6,517,902 | B2 | 2/2003 | Drake et al. |
| 6,533,050 | B2 | 3/2003 | Molloy |
| 6,561,293 | B2 | 5/2003 | Minikus et al. |
| 6,562,462 | B2 | 5/2003 | Griffin et al. |
| D477,225 | S | 7/2003 | Pinnavaia |
| 6,585,326 | B2 | 7/2003 | Sollami |
| 6,592,985 | B2 | 7/2003 | Griffin et al. |
| 6,594,881 | B2 | 7/2003 | Tibbitts |
| 6,596,225 | B1 | 7/2003 | Pope et al. |
| 6,601,454 | B1 | 8/2003 | Botnan |
| 6,601,662 | B2 | 8/2003 | Matthias et al. |
| 6,622,803 | B2 | 9/2003 | Harvey et al. |
| 6,668,949 | B1 | 12/2003 | Rives |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay et al. |
| 6,711,060 | B2 | 3/2004 | Sakakibara |
| 6,719,074 | B2 | 4/2004 | Tsuda et al. |
| 6,729,420 | B2 | 5/2004 | Mensa-Wilmot |
| 6,732,817 | B2 | 5/2004 | Dewey et al. |
| 6,732,914 | B2 | 5/2004 | Cadden et al. |
| 6,733,087 | B2 | 5/2004 | Hall et al. |
| 6,739,327 | B2 | 5/2004 | Sollami |
| 6,749,033 | B2 | 6/2004 | Griffin et al. |
| 6,758,530 | B2 | 7/2004 | Sollami |
| D494,031 | S | 8/2004 | Moore, Jr. |
| D494,064 | S | 8/2004 | Hook |
| 6,786,557 | B2 | 9/2004 | Montgomery, Jr. |

(56) References Cited

U.S. PATENT DOCUMENTS

| | | | |
|---|---|---|---|
| 6,802,676 | B2 | 10/2004 | Noggle |
| 6,822,579 | B2 | 11/2004 | Goswami et al. |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Griffin et al. |
| 6,878,447 | B2 | 4/2005 | Griffin et al. |
| 6,880,744 | B2 | 4/2005 | Noro et al. |
| 6,889,890 | B2 | 5/2005 | Yamazaki et al. |
| 6,929,076 | B2 | 8/2005 | Fanuel et al. |
| 6,933,049 | B2 | 8/2005 | Wan et al. |
| 6,953,096 | B2 | 10/2005 | Gledhill et al. |
| 6,959,765 | B2 | 11/2005 | Bell |
| 6,962,395 | B2 | 11/2005 | Mouthaan |
| 6,966,611 | B1 | 11/2005 | Sollami |
| 6,994,404 | B1 | 2/2006 | Sollami |
| 7,048,081 | B2 | 5/2006 | Smith et al. |
| 7,152,703 | B2 | 12/2006 | Meiners et al. |
| 7,204,560 | B2 | 4/2007 | Mercier et al. |
| D547,652 | S | 7/2007 | Kerman et al. |
| 7,258,741 | B2 | 8/2007 | Linares et al. |
| D560,699 | S | 1/2008 | Omi |
| 7,350,601 | B2 | 4/2008 | Belnap et al. |
| 7,377,341 | B2 | 5/2008 | Middlemiss et al. |
| 7,380,888 | B2 | 6/2008 | Ojanen |
| 7,396,086 | B1 | 7/2008 | Hall et al. |
| 7,543,662 | B2 | 6/2009 | Belnap et al. |
| 7,575,425 | B2 | 8/2009 | Hall et al. |
| 7,592,077 | B2 | 9/2009 | Gates, Jr. et al. |
| 7,665,552 | B2 | 2/2010 | Hall et al. |
| 7,703,559 | B2 | 4/2010 | Shen et al. |
| 7,730,977 | B2 | 6/2010 | Achilles |
| 7,757,785 | B2 | 7/2010 | Zhang et al. |
| 2001/0004946 | A1 | 6/2001 | Jensen |
| 2002/0074851 | A1 | 6/2002 | Montgomery |
| 2002/0153175 | A1 | 10/2002 | Ojanen |
| 2002/0175555 | A1 | 11/2002 | Mercier |
| 2003/0044800 | A1 | 3/2003 | Connelly et al. |
| 2003/0079565 | A1 | 5/2003 | Liang et al. |
| 2003/0141350 | A1 | 7/2003 | Noro et al. |
| 2003/0209366 | A1 | 11/2003 | McAlvain |
| 2003/0213621 | A1 | 11/2003 | Britten et al. |
| 2003/0217869 | A1 | 11/2003 | Snyder et al. |
| 2003/0234280 | A1 | 12/2003 | Cadden et al. |
| 2004/0026132 | A1 | 2/2004 | Hall et al. |
| 2004/0026983 | A1 | 2/2004 | McAlvain |
| 2004/0065484 | A1 | 4/2004 | McAlvain |
| 2004/0155096 | A1 | 8/2004 | Zimmerman et al. |
| 2004/0238221 | A1 | 12/2004 | Runia et al. |
| 2004/0256155 | A1 | 12/2004 | Kriesels et al. |
| 2004/0256442 | A1 | 12/2004 | Gates et al. |
| 2005/0044800 | A1 | 3/2005 | Hall et al. |
| 2005/0159840 | A1 | 7/2005 | Lin et al. |
| 2005/0173966 | A1 | 8/2005 | Mouthaan |
| 2005/0263327 | A1 | 12/2005 | Meiners et al. |
| 2006/0060391 | A1 | 3/2006 | Eyre et al. |
| 2006/0086537 | A1 | 4/2006 | Dennis |
| 2006/0086540 | A1 | 4/2006 | Griffin et al. |
| 2006/0162969 | A1* | 7/2006 | Belnap et al. ..... 175/433 |
| 2006/0180354 | A1 | 8/2006 | Belnap et al. |
| 2006/0186724 | A1 | 8/2006 | Stehney |
| 2006/0237236 | A1 | 10/2006 | Sreshta et al. |
| 2007/0193782 | A1 | 8/2007 | Fang et al. |
| 2007/0278017 | A1 | 12/2007 | Shen et al. |
| 2008/0006448 | A1 | 1/2008 | Zhang et al. |
| 2008/0053710 | A1 | 3/2008 | Moss |
| 2008/0073126 | A1 | 3/2008 | Shen et al. |
| 2008/0073127 | A1 | 3/2008 | Zhan et al. |
| 2008/0142276 | A1 | 6/2008 | Griffo et al. |
| 2008/0156544 | A1 | 7/2008 | Singh et al. |
| 2008/0206576 | A1 | 8/2008 | Qian et al. |
| 2008/0264696 | A1 | 10/2008 | Dourfaye et al. |

OTHER PUBLICATIONS

International Search Report received in corresponding International Application No. PCT/US/2007/075670, dated May 2, 2009, (3 pages).

International Preliminary Report on Patentability (Chapter I of the PCT), received in corresponding International Application No. PCT/US2007/075670, dated Feb. 17, 2009 (6 pages).

International Preliminary Report on Patentability (Chapter II of the PCT), received in corresponding International Application No. PCT/US2007/075670, dated Jan. 1, 2010 (4 pages).

Office Action dated Jul. 20, 2012, received in corresponding U.S. Appl. No. 12/112,099 (14 pages).

* cited by examiner

LAYERED POLYCRYSTALLINE DIAMOND

CROSS-REFERENCE TO RELATED APPLICATION

The present application is a continuation application of U.S. patent application Ser. No. 12/112,099 filed on Apr. 30, 2008.

BACKGROUND OF THE INVENTION

The present invention relates to high impact wear resistant tools that may be used in machinery such as crushers, picks, grinding mills, roller cone bits, rotary fixed cutter bits, earth boring bits, percussion bits or impact bits, and drag bits. More particularly, the invention relates to inserts comprised of a carbide substrate with a non-planar interface and an abrasion resistant layer of superhard material affixed thereto using a high pressure high temperature press apparatus. Such inserts typically comprise a superhard material layer or layers formed under high temperature and pressure conditions, usually in a press apparatus designed to create such conditions, cemented to a carbide substrate containing a metal binder or catalyst such as cobalt. The substrate is often softer than the superhard material to which it is bound. Some examples of superhard materials that high pressure high temperature (HPHT) presses may produce and sinter include cemented ceramics, diamond, polycrystalline diamond, and cubic boron nitride. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the high pressure high temperature press apparatus. The substrates and adjacent diamond crystals are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such inserts are often subjected to intense forces, torques, vibration, high temperatures and temperature differentials during operation. As a result, stresses within the structure may begin to form. Drill bits for example may exhibit stresses aggravated by drilling anomalies during well boring operations such as bit whirl or bounce often resulting in spalling, delamination or fracture of the superhard material or the substrate thereby reducing or eliminating the cutting elements efficacy and decreasing overall drill bit wear life. The superhard material of an insert sometimes delaminates from the carbide substrate after the sintering process as well as during percussive and abrasive use. Damage typically found in percussive and drag bits may be a result of shear failures, although non-shear modes of failure are not uncommon. The interface between the superhard material and substrate is particularly susceptible to non-shear failure modes due to inherent residual stresses.

U.S. Pat. No. 7,258,741 to Linares et al., which is herein incorporated by reference for all that it contains, discloses synthetic monocrystalline diamond compositions having one or more monocrystalline diamond layers formed by chemical vapor deposition, the layers including one or more layers having an increased concentration of one or more impurities (such as boron and/or isotopes of carbon), as compared to other layers or comparable layers without such impurities. Such compositions provide an improved combination of properties, including color, strength, velocity of sound, electrical conductivity, and control of defects. A related method for preparing such a composition is also described, as well as a system for use in performing such a method, and articles incorporating such a composition.

U.S. Pat. No. 6,562,462 to Griffin et al., which is herein incorporated by reference for all that it contains, discloses a polycrystalline diamond or a diamond-like element with greatly improved wear resistance without loss of impact strength. These elements are formed with a binder-catalyzing material in a high-temperature, high-pressure (HTHP) process. The PCD element has a body with a plurality of bonded diamond or diamond-like crystals forming a continuous diamond matrix that has a diamond volume density greater than 85%. Interstices among the diamond crystals form a continuous interstitial matrix containing a catalyzing material. The diamond matrix table is formed and integrally bonded with a metallic substrate containing the catalyzing material during the HTHP process. The diamond matrix body has a working surface, where a portion of the interstitial matrix in the body adjacent to the working surface is substantially free of the catalyzing material, and the remaining interstitial matrix contains the catalyzing material. Typically, less than about 70% of the body of the diamond matrix table is free of the catalyzing material.

BRIEF SUMMARY OF THE INVENTION

In one aspect of the present invention, a high impact wear resistant tool has a superhard material bonded to a cemented metal carbide substrate at a non-planar interface. The superhard material has a thickness of at least 0.100 inch and forms an 1.0 included angle of 35 to 55 degrees. The superhard material has a plurality of substantially distinct diamond layers. Each layer of the plurality of layers has a different catalyzing material concentration. A diamond layer adjacent the substrate of the superhard material has a higher catalyzing material concentration than a diamond layer at a distal end of the superhard material.

The plurality of layers may comprise a varying layer thickness or a uniform layer thickness. More specifically, the diamond layer may comprise a thickness between 0.010 and 0.100 inch. The plurality of layers may comprise various geometries including inverted cone-shaped, straight, cone-shaped, irregular, or combinations thereof. A volume of the superhard material may comprise 75 to 150 percent of a volume of the substrate. A thickness of at least one layer of the plurality of layers may be as thick as a thickness of the substrate. The diamond layer adjacent the substrate may have a catalyzing material concentration between 5 and 10 percent. The diamond layer at the distal end of the superhard material may have a catalyzing material concentration between 2 and 5 percent. The diamond layer at the distal end of the superhard material may be leached. The leached diamond layer may comprise a catalyzing material concentration of 0 to 1 percent. The superhard material may have a substantially pointed geometry with an apex having a 0.050 to 0.125 inch radius. The substantially pointed geometry may have a convex or a concave side. The high impact wear resistant tool may be incorporated in drill bits, percussion drill bits, roller cone bits, shear bits, milling machines, indenters, mining picks, asphalt picks, cone crushers, vertical impact mills, hammer mills, jaw crushers, asphalt bits, chisels, trenching machines, or combinations thereof. The substrate may be bonded to an end of the carbide segment; the carbide segment being brazed or press fit to a steel body. The superhard material may be a polycrystalline structure with an average grain size of 1 to 100 microns. The catalyzing material nay be selected from the group consisting of cobalt, nickel, iron, titanium, tantalum, niobium, alloys thereof, and combinations thereof. The plurality of layers of the superhard material may buttress each other, thereby increasing the strength of the superhard material.

DETAILED DESCRIPTION OF THE INVENTION AND THE PREFERRED EMBODIMENT

Figure 1:
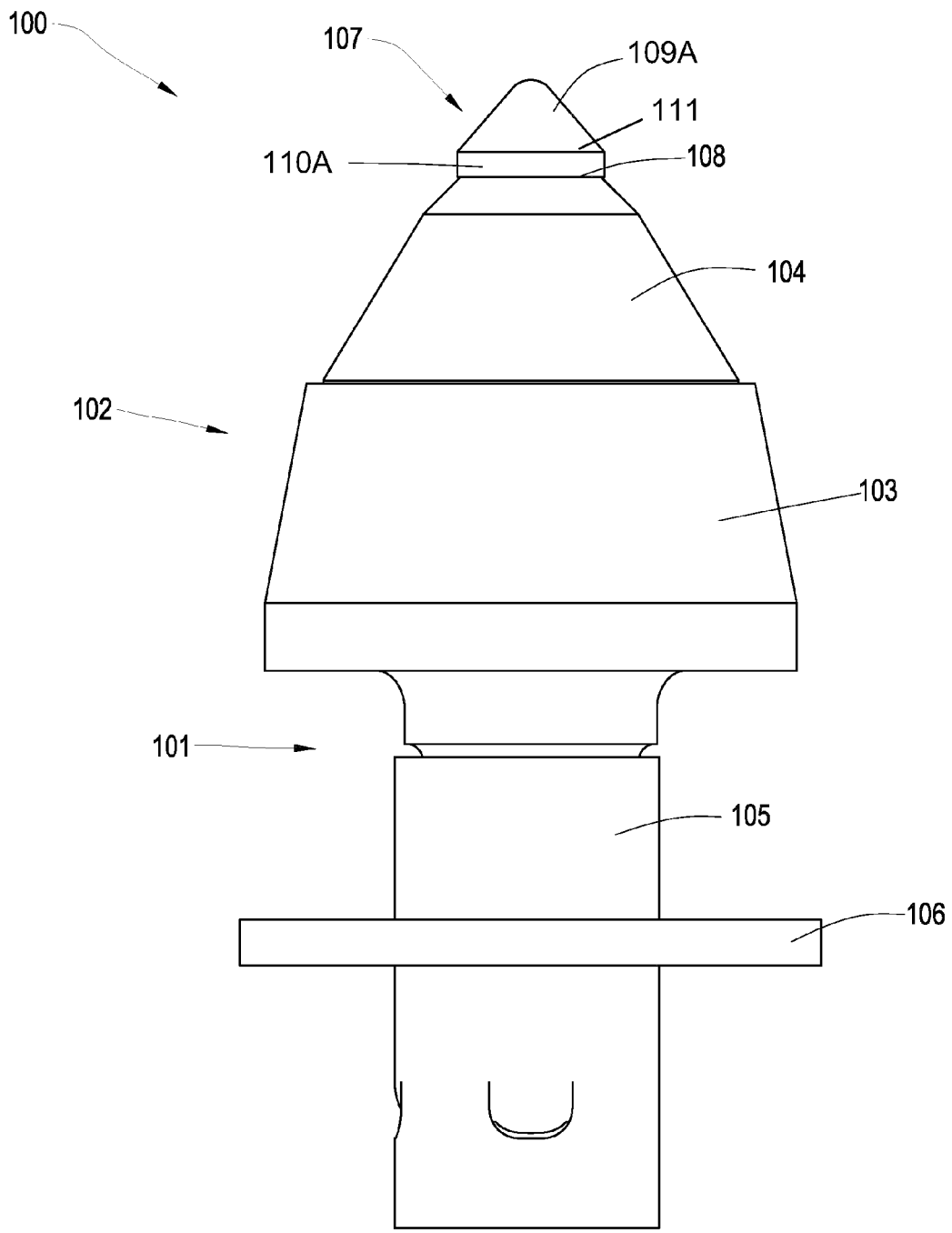
FIG. 1 is a perspective diagram of an embodiment of a high impact wear resistant tool

FIG. 1 is a perspective diagram of an embodiment of a high impact wear resistant tool 100. The tool 100 may be used in machines in mining, asphalt milling, drilling, or trenching industries. The tool 100 may comprise a shank 101 and a body 102, the body 102 being divided into first and second segments 103, 104. The first segment 103 may generally be made of steel, while the second segment 104 may be made of a harder material such as cemented metal carbide. The second segment 104 may be bonded to the first segment 103 by brazing to prevent the second segment 104 from detaching from the first segment 103.

The shank 101 may be adapted to be attached to a driving mechanism. A protective spring sleeve 105 may be disposed around the shank 101 both for protection and to allow the high impact wear resistant tool to be press fit into a holder while still being able to rotate. A washer 106 may also be disposed around the shank 101 such that when the high impact resistant tool 100 is inserted into a holder, the washer 106 protects an upper surface of the holder and also facilitates rotation of the tool. The washer 106 and sleeve 105 may be advantageous in protecting the holder, thereby extending the life of the holder; the holder being is costly to replace.

The high impact wear resistant tool 100 also comprises a tip 107 bonded to a frustoconical end 108 of the second segment 104 of the body 102. The tip 107 comprises a superhard material 109 bonded to a cemented metal carbide substrate 110 at a non-planar interface. The tip may be bonded to the substrate through a high temperature high pressure process. The superhard material 109 may comprise diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, non-metal catalyzed diamond, or combinations thereof.

The superhard material 109 may be a polycrystalline structure with an average grain size of 10 to 100 microns. The cemented metal carbide substrate 110 may comprise a 1 to 40 percent concentration of cobalt by weight, preferably 5 to 10 percent.

Figure 2:
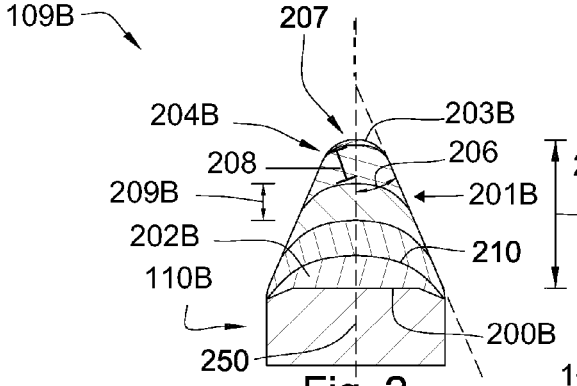
FIG. 2 is a cross-sectional diagram of an embodiment of a superhard material.

FIGS. 2 through 6 illustrate various embodiments of a superhard material 109 bonded to a substrate 110. Referring now to FIG. 2, the superhard material 109 bonded to the substrate 110 at a non-planar interface 200 may comprise a plurality of substantially distinct diamond layers 201. Each layer of the plurality of layers 201 may comprise a different catalyzing material concentration. A diamond layer 202 adjacent the substrate 110 of the superhard material 109 may have a higher catalyzing material concentration than a diamond layer 203 at a distal end 204 of the superhard material 109.

The superhard material 109 may have a thickness 205 of at least 0.100 inch and may form an included angle 206 of 35 to 55 degrees; the included angle 206 being formed between a central axis 250 of the superhard material and a side of the superhard material. The superhard material 109 may have a substantially pointed geometry with an apex 207 comprising a 0.050 to 0.125 inch radius 208. In this embodiment, the layers 201 of the superhard material may comprise a substantially uniform layer thickness 209. The layers may comprise a thickness 209 between 0.010 and 0.100 inch. The layers may also have a substantially conical-shaped geometry 210 or a rounded geometry.

Figure 3A:
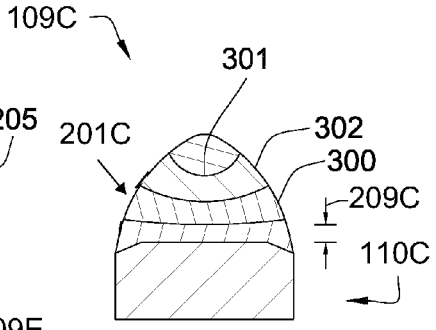
FIG. 3*a* is a cross-sectional diagram of another embodiment of a superhard material.

FIG. 3*a* illustrates another embodiment of the superhard material 109. In some embodiments, a volume of the superhard material 109 may comprise 75 to 150 percent of a volume of the substrate. A volume of at least one layer 300 of the plurality of layers 201 may comprise 10 to 100 percent of the volume of the substrate. In this embodiment, the thickness 209 of each diamond layer 201 may vary. The plurality of layers 201 may have an inverted cone-shaped geometry 301. It is believed that this geometry may cause the plurality of layers 201 to buttress each other upon impact. In this embodiment, at least one layer may also have a substantially straight geometry. In this embodiment, the superhard material may have a convex side 302. The embodiment of FIG. 3*a* also discloses the layers having a plurality of different types of geometries.

Figure 3B:
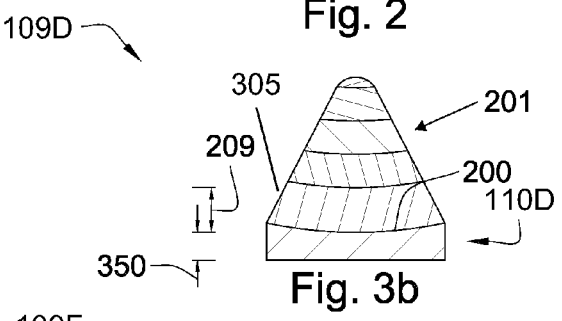
FIG. 3*b* is a cross-sectional diagram of another embodiment of a superhard material.

FIG. 3*b* shows an embodiment of the superhard material 109 with a plurality of layers 201 forming an inverted cone shaped geometry. In this embodiment, the thickness 209 of at least one of the plurality of layers 201 may be as thick as a thickness 350 of the substrate 110. The non-planer interface 200 may comprise an inverted cone-shaped geometry. The interface between the first diamond layer and the carbide substrate also form an inverted cone geometry.

Figure 4:
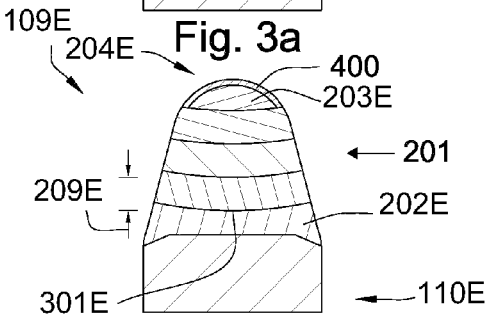
FIG. 4 is a cross-sectional diagram of another embodiment of a superhard material.

In the embodiment of FIG. 4, the plurality of layers 201 may have an inverted cone-shaped geometry 301 and may have a substantially uniform layer thickness 209. In some embodiments, the diamond layer 202 adjacent the substrate 110 of the superhard material 109 may have a catalyzing material concentration between 5 and 10 volume percent. The diamond layer 203 at the distal end 204 of the superhard material may comprise a catalyzing material concentration less than that of the layer 202 adjacent the substrate 110. The distal layer 203 may comprise a catalyzing material concentration between 2 and 5 volume percent. Also in this embodiment, the distal layer 203 of the superhard material 109 may be leached so that a portion 400 of the distal layer 203 may comprise a catalyzing material concentration of 0 to 1 percent.

Figure 5A:
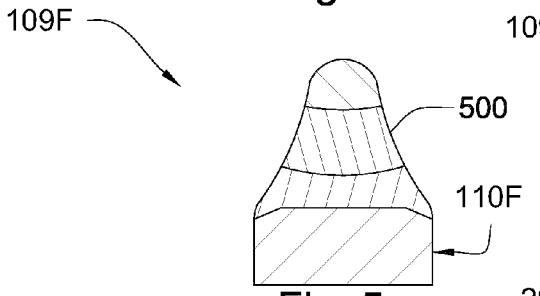
FIG. 5*a* is a cross-sectional diagram of another embodiment of a superhard material.
Figure 5B:
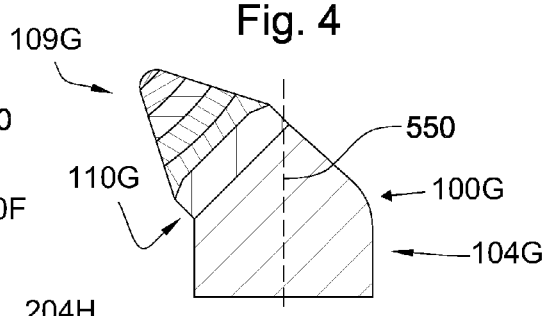
FIG. 5*b* is a cross-sectional diagram of another embodiment of a superhard material.
Figure 6:
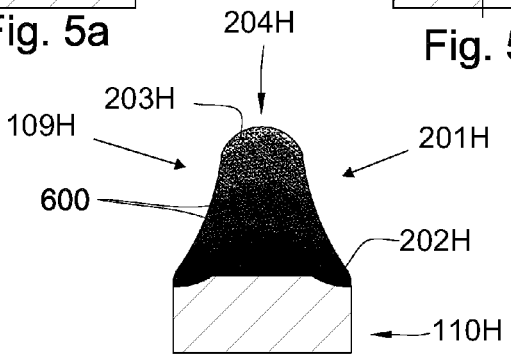
FIG. 6 is a cross-sectional diagram of another embodiment of a superhard material.

Referring now to FIG. 5*a*, the superhard material 109 may comprise a concave side 500. FIG. 5*b* illustrates an embodiment of a superhard material 109 attached to a substrate 110; the substrate being bonded to the second segment 104 of the body of the tool. The substrate 110 and the superhard material 109 may be bonded at an angle with respect to a central axis 550 of the body of the tool. The embodiment of FIG. 6 illustrates a superhard material 109 having a plurality of layers 201; the plurality of layers 201 having different catalyzing material concentrations. The catalyzing material may be selected from the group consisting of cobalt, nickel, iron, titanium, tantalum, niobium, alloys thereof, and combinations thereof. During a high temperature high pressure process, the catalyzing material of each layer may diffuse into the surrounding layers such that the concentration of catalyzing material forms a general gradient 600 within the superhard material 109. The diamond layer 202 adjacent the substrate 110 has a higher catalyzing material concentration than the diamond layer 203 at the distal end 204 of the superhard material.

Figure 7A:
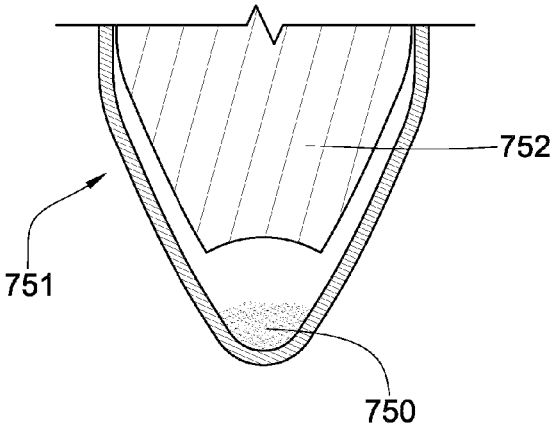
FIG. 7*a* is a cross-sectional diagram of an embodiment of a superhard material disposed in an assembly can.
Figure 7B:
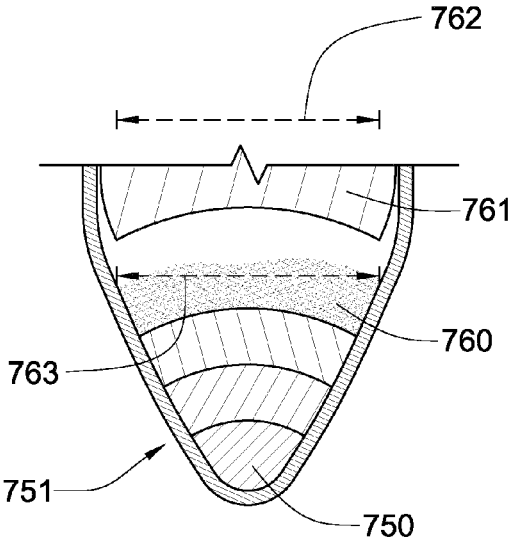
FIG. 7*b* is a cross-sectional diagram of another embodiment of a superhard material disposed in an assembly can.
Figure 7C:
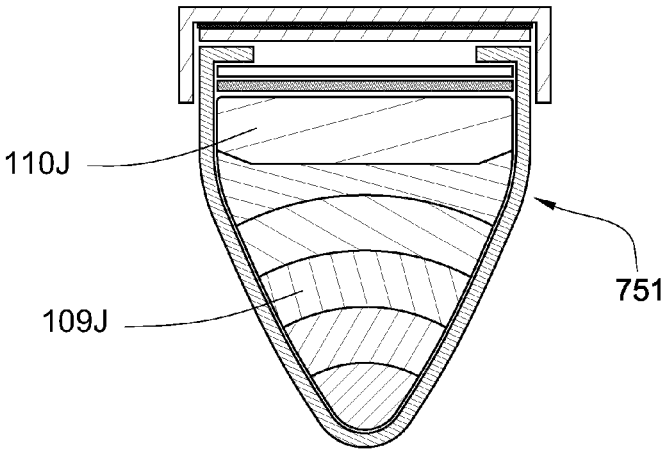
FIG. 7*c* is a cross-sectional diagram of another embodiment of a superhard material disposed in an assembly can.

FIGS. 7*a* through 7*c* illustrate a process for assembling the superhard material and the substrate. In the embodiment of FIG. 7*a*, a first diamond powder layer 750 having a specific concentration of catalyzing material is inserted into a can 751; the can having the desired shape of a completed superhard material. A first shaping tool 752 is then inserted into the can 751; the shaping tool being adapted to form the diamond powder layer 750 into the desired geometry. In this embodiment, the desired geometry comprises an inverted cone-shape. Referring now to FIG. 7*b*, the process of inserting a layer of diamond powder into the can and shaping the layer using a shaping tool is repeated. In this embodiment, a fourth diamond layer 760 is being shaped using a fourth shaping tool 761. The fourth diamond layer 760 comprises a higher catalyzing material concentration than the first diamond layer 750. The size of the shaping tool also increases as the number of layers increases so that the shaping tool may have an end diameter 762 equal to the respective inside diameter 763 of the can 751. FIG. 7*c* illustrates the can 751 holding an assembled superhard material 109 and substrate 110.

Figure 8:
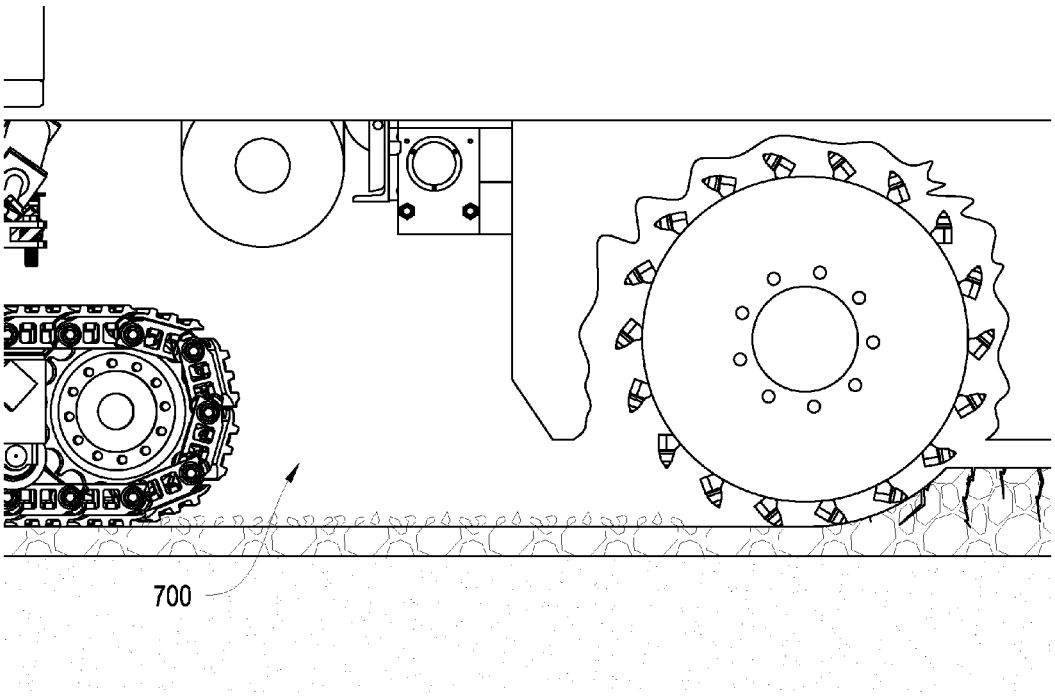
FIG. 8 is a cross-sectional diagram of an embodiment of an asphalt milling machine.
Figure 9:
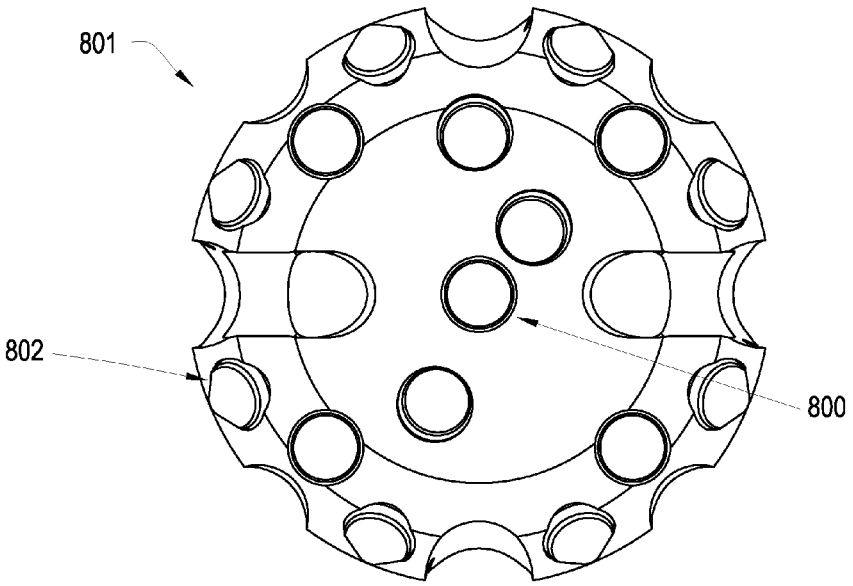
FIG. 9 is an orthogonal diagram of an embodiment of a percussion bit.
Figure 10:
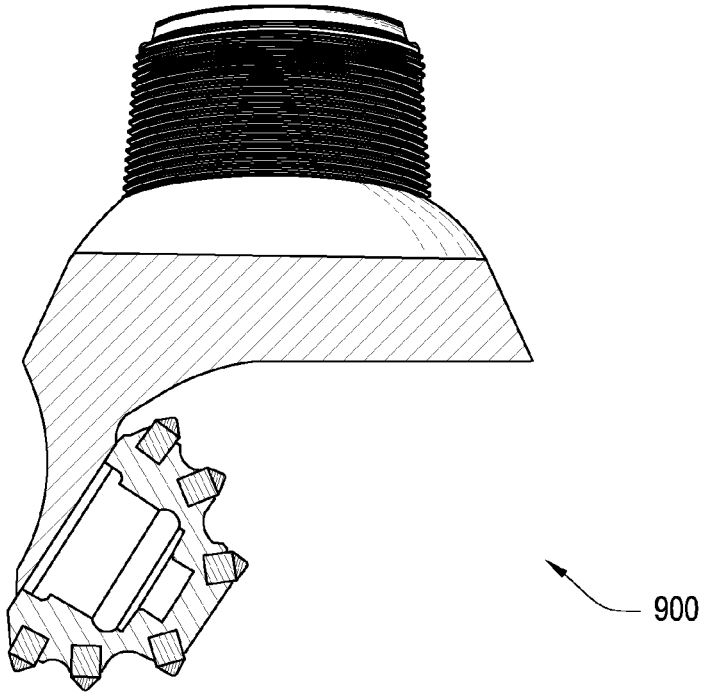
FIG. 10 is a cross-sectional diagram of an embodiment of a roller cone bit.
Figure 11:
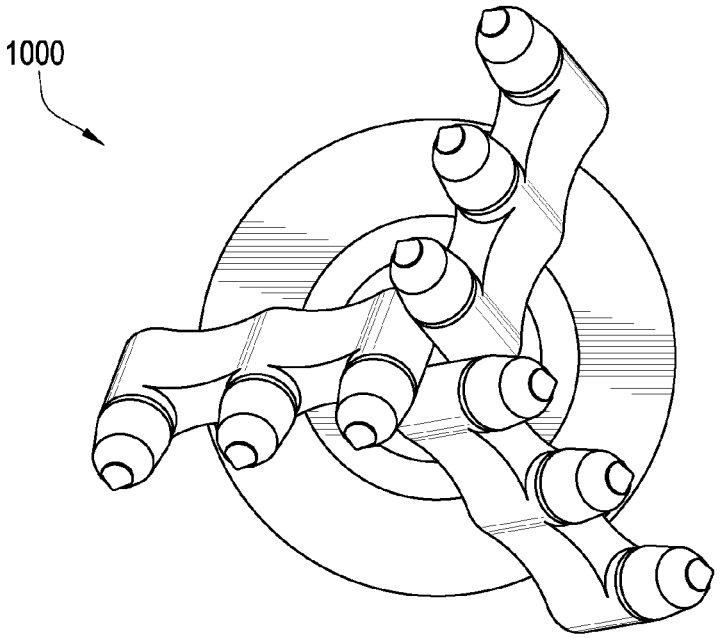
FIG. 11 is a perspective diagram of an embodiment of a mining bit.

The high impact wear resistant tool may be incorporated in drill bits, percussion drill bits, roller cone bits, shear bits, milling machines, indenters, mining picks, asphalt picks, cone crushers, vertical impact mills, hammer mills, jaw crushers, asphalt bits, chisels, trenching machines, or combinations thereof. FIGS. 8 through 13 illustrate various applications in which the high impact wear resistant tool of the present invention may be incorporated. Referring now to FIG. 7, the tool may be a pick in an asphalt milling machine 700. The tool may also be an insert in a drill bit, as in the embodiments of FIGS. 8 through 11. In percussion bits, as illustrated in FIG. 8, the pointed geometry may be useful in central locations 800 on the bit face 801 or at the gauge 802 of the bit face. Further, FIG. 9 shows that the pointed layered diamond bit may be useful in roller cone bits 900, wherein the inserts typically fail, the formation through compression. The layered diamond bits may be angled to enlarge the gauge well bore. FIG. 10 discloses a mining bit 1000 that may also be incorporated with the present invention. FIG. 11 discloses a drill bit 1100 typically used in horizontal drilling.

Figure 12:
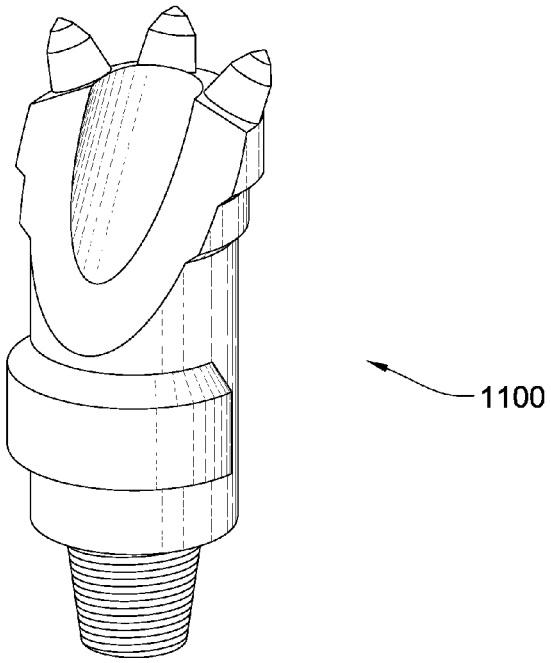
FIG. 12 is an orthogonal diagram of an embodiment of a drill bit.
Figure 13:
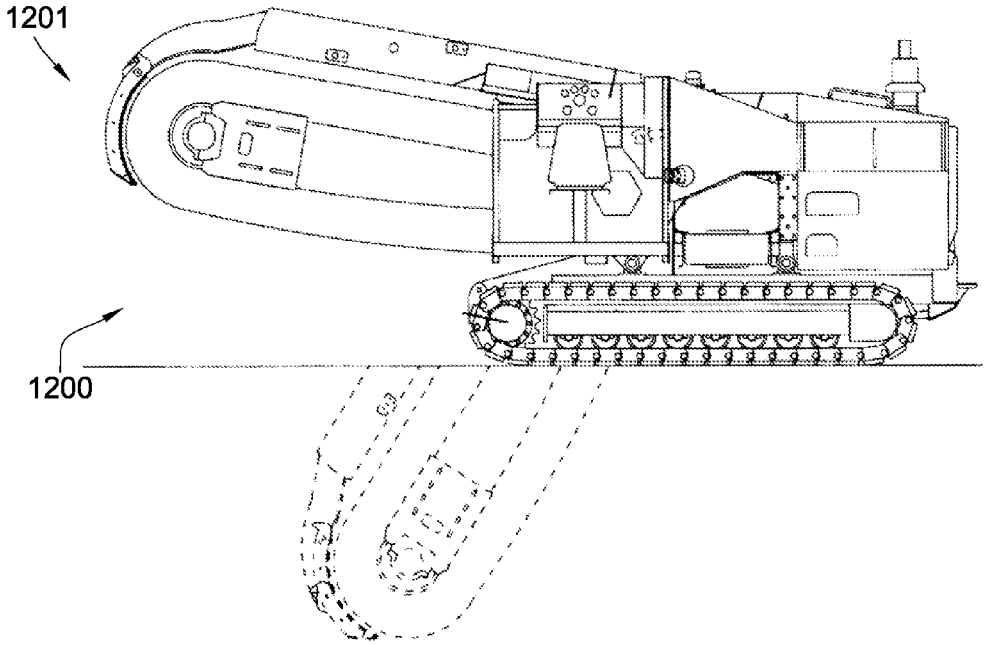
FIG. 13 is a perspective diagram of an embodiment of a trenching machine.

Referring now to FIG. 12, the tool may be used in a trenching machine 1200. The tools may be placed on a chain that rotates around an arm 1201.

Whereas the present invention has been described in particular relation to the drawings attached hereto, it should be understood that other and further modifications apart from those shown or suggested herein, may be made within the scope and spirit of the present invention.

What is claimed is:

1. A tip for use in a high impact, wear resistant tool, the tip comprising:

a substrate having a base end and a non-planar interface spaced apart from said base end; and a superhard material bonded to said non-planar interface and having a distal end with an apex spaced apart from said non-planar interface, said superhard material having a thickness of at least 0.100 inches, and said superhard material having a plurality of diamond layers, at least one of the plurality of layers having an inverted cone geometry, wherein the inverted cone geometry is inverted with respect to the apex of the superhard material and having a center of curvature distal to said at least one layer.

2. The tip of claim 1, wherein said plurality of diamond layers comprise a first diamond layer with a first thickness and a second diamond layer with a second thickness.

3. The tip of claim 2, wherein said first thickness differs from said second thickness.

4. The tip of claim 2, wherein said first thickness and said second thickness being substantially the same.

5. The tip of claim 2, wherein said first thickness is between 0.010 inches and 0.100 inches, and said second thickness is between 0.010 inches and 0.100 inches.

6. The tip of claim 1, wherein said superhard material has a first volume and said substrate has a second volume and wherein said first volume is 75 percent to 150 percent of said second volume.

7. The tip of claim 1, wherein at least one diamond layer comprises a differing catalyzing material concentration as compared to at least one adjacent diamond layer.

8. The tip of claim 1, wherein the tip is disposed on one of percussion bit, a roller cone bit, and a shear bit.

9. A tip for use in a high impact, wear resistant tool, the tip comprising:

a substrate having a base end and a non-planar interface spaced apart from said base end; and a superhard material bonded to said non-planar interface and having a distal end with an apex spaced apart from said non-planar interface, said superhard material having a thickness of at least 0.100 inches, and said superhard material having a plurality of diamond layers, at least one of the plurality of layers having a concave upper surface having a non-zero value of curvature along its length.

10. The tip of claim 9, wherein said plurality of diamond layers comprise a first diamond layer with a first thickness and a second diamond layer with a second thickness.

11. The tip of claim 10, wherein said first thickness differs from said second thickness.

12. The tip of claim 10, wherein said first thickness and said second thickness being substantially the same.

13. The tip of claim 10, wherein said first thickness is between 0.010 inches and 0.100 inches, and said second thickness is between 0.010 inches and 0.100 inches.

14. The tip of claim 9, wherein said superhard material has a first volume and said substrate has a second volume and wherein said first volume is 75 percent to 150 percent of said second volume.

15. The tip of claim 9, wherein at least one diamond layer comprises a differing catalyzing material concentration as compared to at least one adjacent diamond layer.

16. The tip of claim 9, wherein the tip is disposed on one of percussion bit, a roller cone bit, and a shear bit.

17. A drill bit comprising:

a bit face; and at least one insert disposed on the bit face, the at least one insert comprising:

a substrate having a base end and a non-planar interface spaced apart from said base end; and a superhard material bonded to said non-planar interface and having a distal end with an apex spaced apart from said non-planar interface, said superhard material having a thickness of at least 0.100 inches, and said superhard material having a plurality of diamond layers, at least one of the plurality of layers having an inverted cone geometry, wherein the inverted cone geometry is inverted with respect to the apex of the superhard material and having a center of curvature distal to said at least one layer.

18. The drill bit of claim 17, wherein the drill bit is a shear bit.

19. A drill bit comprising:

a bit face; and at least one insert disposed on the bit face, the at least one insert comprising:

a substrate having a base end and a non-planar interface spaced apart from said base end; and a superhard material bonded to said non-planar interface and having a distal end with An apex spaced apart from said non-planar interface, said superhard material having a thickness of at least 0.100 inches, and said superhard material having a plurality of diamond layers, at least one of the plurality of layers having a concave upper surface having a non-zero value of curvature along its length.

20. The drill bit of claim 19, wherein the drill bit is a shear bit.

* * * * *